US005529117A

United States Patent [19]

Voss et al.

[11] Patent Number: 5,529,117

[45] Date of Patent: Jun. 25, 1996

[54] HEAT EXCHANGER

[75] Inventors: Mark G. Voss, Franksville; Dennis C. Granetzke, Racine, both of Wis.

[73] Assignee: Modine Manufacturing Co., Racine, Wis.

[21] Appl. No.: 525,979

[22] Filed: Sep. 7, 1995

[51] Int. Cl.[6] ..... F28F 9/26

[52] U.S. Cl. ..... 165/144; 165/149; 165/178; 165/173; 165/DIG. 80; 165/176

[58] Field of Search ..... 165/144, 153, 165/173, 178, 149, 126

[56] References Cited

U.S. PATENT DOCUMENTS

| | | | |
|---|---|---|---|
| 4,867,486 | 9/1989 | Fukata et al. | 285/222 |
| 4,938,284 | 7/1990 | Howells | 165/149 |
| 5,042,577 | 8/1991 | Suzumura | 165/153 |
| 5,086,835 | 2/1992 | Shinmura | 165/144 |
| 5,157,944 | 10/1992 | Hughes et al. | 62/515 |
| 5,348,081 | 9/1994 | Halstead et al. | 165/144 |

*Primary Examiner*—Allen J. Flanigan
*Attorney, Agent, or Firm*—Wood, Phillips, VanSanten, Clark & Mortimer

[57] ABSTRACT

The lack of flexibility in selecting locations for inlets or outlets or crossovers for a heat exchange fluid in a heat exchanger can be minimized in a heat exchanger construction including first and second spaced, generally parallel, tubular headers (10), (12) having opposed ends with a plurality of tubes (20) in parallel and spaced from one another which extend between and have their ends in fluid communication with the interior of the headers (10), (12). A plurality of fins (22) are located between the headers (10), (12) in heat exchange relation with the plurality of tubes (20) and side pieces, (30) and (32) flank the plurality of tubes (20) as well as the plurality of fins (22) and extend between and are fastened to corresponding ones of the headers (10), (12). One of the side pieces (32) includes an internal passage (60), (62), (64); (78), (80), (82) terminating in a first port (44), (74) in fluid communication with one of the headers (12) and an opposite second port (46), (84) at the other end of the passage (60), (62), (64), (78), (80), (82).

11 Claims, 2 Drawing Sheets

HEAT EXCHANGER

FIELD OF THE INVENTION

This invention relates to heat exchangers, and more particularly, to manifold systems utilized in heat exchangers.

BACKGROUND OF THE INVENTION

Many different types of heat exchangers in use today employ a core construction that includes two or more spaced, generally parallel, tubular headers. A plurality of tubes extend between the headers and are in fluid communication with the interior of the headers. A plurality of fins are located between the headers and in heat exchange relation with the tubes.

In this type of construction, for strength, and/or for mounting purposes, it is customary to include side pieces. The side pieces typically are plates that extend between corresponding ends of the headers. Where the fins are serpentine fins, the end most rows of serpentine fins will customarily be bonded to the side plates. Various mounting fixtures may also be employed in connection with the side plates.

Typical of these constructions is the use of inlet and outlet fittings which are connected to one or the other or both of the headers. When the heat exchangers are, for example, employed in vehicles, the location of other components that are frequently disposed under the hood or dash of the vehicle may often dictate the location of conduits that are to be connected to the heat exchanger. Other constraints, such as the desire to obtain good aerodynamic configurations of the vehicle exterior or maximum interior space to enhance fuel economy also bear on the design of heat exchangers so as to accommodate them within a given envelope under the hood or dash and at a location whereat conduits may be freely run to the inlet and outlet fittings of the headers.

Not infrequently, the use of inlet and outlet fittings on the headers increases the envelope that must be provided to encompass the heat exchanger in the direction extending from one header to another.

Additionally, when connections are made to opposite headers, the conduits, at least at their point of connection to the headers must be spaced which can also create spacial problems in mounting the heat exchanger.

Furthermore, where tubular headers are used, they are typically pierced with a plurality of parallel slots along their length to receive the ends of the tubes that extend between the headers. In many of these constructions, flat sections are formed on the headers oppositely of the slots to receive holes which in turn receive the inlet and/or outlet or cross over fittings. This necessitates a forming operation that desirably would be eliminated.

The present invention is directed to overcoming one or more of the above problems.

SUMMARY OF THE INVENTION

It is the principal object of the invention to provide a new and improved heat exchanger. More specifically, it is an object of the invention to provide a new and improved manifold system for connection to the headers of a heat exchanger.

An exemplary embodiment of the invention achieves the foregoing object in a heat exchanger that includes first and second spaced, generally parallel, tubular headers having opposed ends. A plurality of tubes are located in parallel with one another and are spaced from one another and extend between and have their ends in fluid communication with the interiors of the headers. A plurality of fins are located between the headers and in heat exchange relation with the plurality of tubes. Side pieces flank the plurality of tubes and the plurality of fins and extend between and are fastened to corresponding ones of the opposed ends of the headers. One of the side pieces includes an internal passage terminating in a first port at and in fluid communication with one of the headers at one of the opposed ends and an opposite, second port at the other end of the passage.

In a preferred embodiment, the fins are serpentine fins and are bonded to the side pieces.

In one embodiment of the invention, there are two of the passages, two of the first ports and two of the second ports to provide first and second ports for each passage. The first ports are in fluid communication with different ones of the headers.

In a preferred embodiment of the invention, the second port is located in a side of the side piece remote from the plurality of tubes and the plurality of fins so as to be readily connectable to a fixture or the like.

One embodiment of the invention contemplates the provision of an additional header closely adjacent the one of the headers connected to the passage. The second port of the passage is in fluid communication with the additional header.

According to another embodiment of the invention, there is an additional set of the first and second headers and the plurality of tubes, and the same is located in side by side relation to the first set thereof with the first headers in each set being in close adjacency to one another and the second headers in each set being in close adjacency to one another. There are three of the passages within the side piece and each has first and second ports. The first ports of the first and second passages are in fluid communication with respective ones of the first headers and the second ports of the first and second passages are located oppositely of the plurality of tubes of the respective set. The ports of the third passage are in fluid communication with respective ones of the second headers to define a crossover passage.

In one embodiment of the invention, the side piece comprises a pair of plates with the passage being located at the interface of the plates. In one embodiment of the invention, the plates have a spacer there between to define a laminated side piece. In another embodiment, one of the plates has a peripheral flange and the other of the plates is nested within the peripheral flange in substantial abutment with the other of the plates.

Other objects and advantages will become apparent from the following specification taken in connection with the accompanying drawings.

DESCRIPTION OF THE PREFERRED EMBODIMENTS

Figure 1:
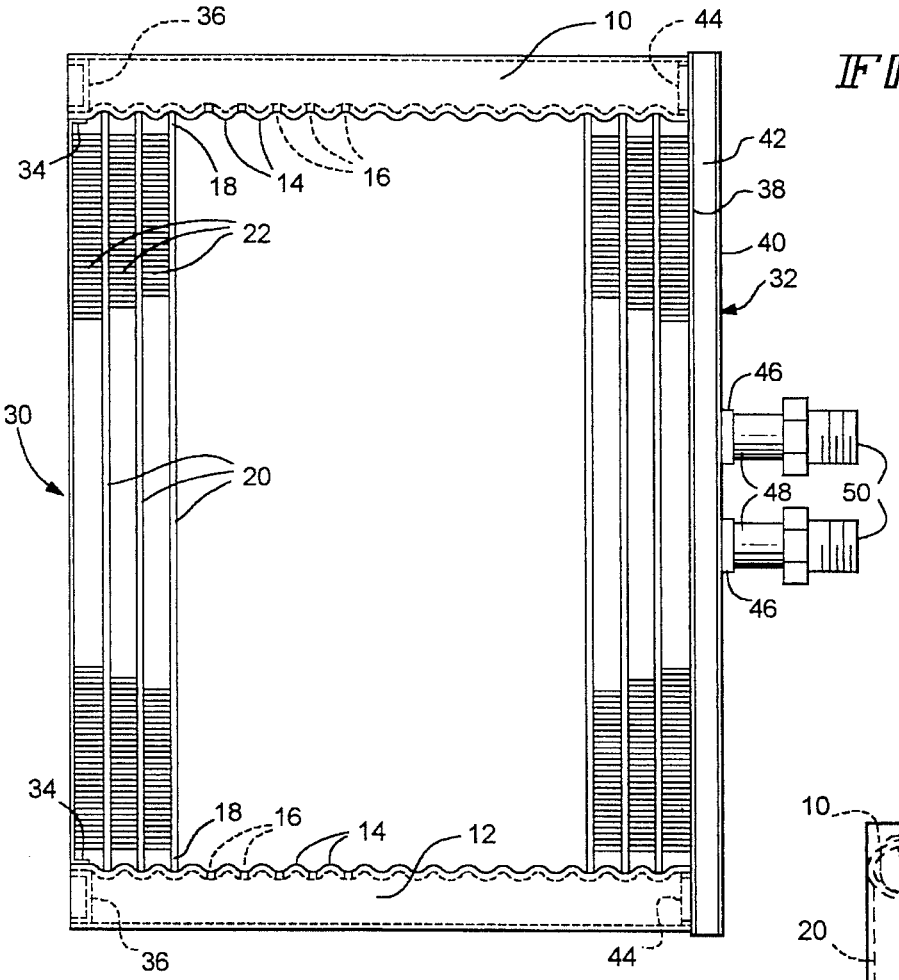
FIG. 1 is an elevation of a heat exchanger made according to the invention.
Figure 2:
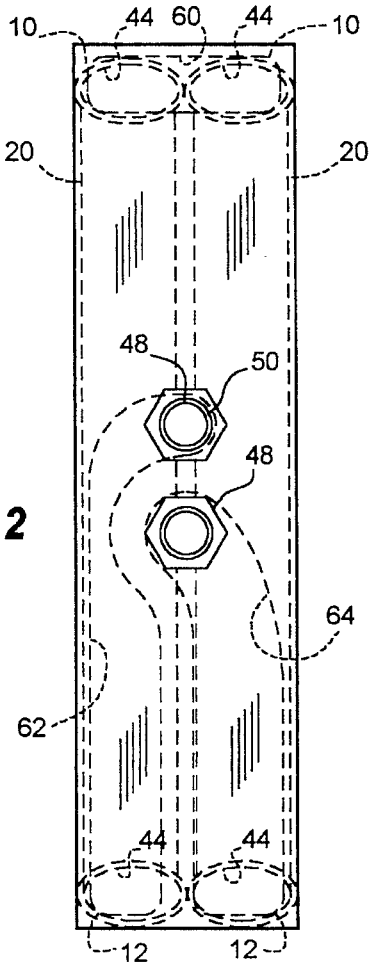
FIG. 2 is an elevation of the heat exchanger taken from the right of FIG. 1.

An exemplary embodiment of a heat exchanger made according to the invention is illustrated in FIGS. 1 and 2 and with reference thereto is seen to include a pair of generally tubular headers, 10, 12, of oval cross section. The headers 10 and 12 are elongated and disposed in a generally parallel relationship with one another as well as being spaced from one another.

On their facing sides, the headers 10 and 12 include pressure domes 14 in the shape of a compound curve as is known in the art. The pressure domes 14 are separated by slots 16 which receive the ends 18 of elongated, flattened tubes 20, typically, but not always, of extruded construction.

A plurality of the tubes 20 extend in parallel, spaced relationship between the headers 10 and 12 as illustrated in FIG. 1. A plurality of fins 22 are located between the headers 10 and 12 and are in heat exchange relationship with the tubes 20. In the usual case, the fins 22 will be brazed to the tubes 20 as when the fins 22 are serpentine fins as illustrated in FIG. 1. However, if plate fins are used, a mere mechanical contact may be employed in lieu of a metallurgical bond.

The construction is completed by first and second side pieces, generally designated 30 and 32, respectively. The side piece 30 is conventional and includes inwardly directed tabs 34 at its opposite ends which are secured as by brazing to respective ones of the headers 10 and 12. The adjacent fin 22 is also typically brazed to the side piece 30. The side piece 30 and the side piece 32 tend to stabilize the overall construction against the various forces that it may incur in use. For example, if used in a vehicular application, the heat exchanger will typically be subjected to substantial vibration, pressure cycling and thermal cycling; and the side pieces 30 and 32 provide strength to resist the destructive forces generated during such vibration and/or cycling.

The ends of the headers 10 and 12 adjacent the side piece 30 are sealed by conventional end caps 36.

The side piece 32 is considerably different from the side piece 30. It is made up of an inner manifold plate 38, an outer manifold plate 40 and a spacer plate 42. The inner manifold plate 38 includes an integrally formed nipple 44 at each end. Each nipple 44 is sized to be snugly received within the adjacent open end of a corresponding one of the headers 10, 12 and to be brazed thereto to be sealed thereto.

A spacer plate 42 includes three internal passages as will be described in greater detail hereinafter while the outer manifold plate 40 includes a pair of integrally formed nipples 46 that extend oppositely of the nipples 44, that is, away from tubes 20 and the fins 22. The nipples 46 may receive fittings 48 which terminate in threaded ends 50 whereby fluid conduits may be connected to the same. The nipples 44 and 46 may be formed in the plates 38 and 40 by a stamping operation.

As seen in FIG. 2, there are in actuality two rows of the tubes 22 extending between two of the headers 10 and two of the headers 12. That is to say, two cores, each including a header 10, a header 12 and tubes 22 extending between the same are provided. They are located in side by side relationship with the headers 10 in close adjacency to each other and with the headers 12 in close adjacency to each other.

The fins 22 may be a single set of fins extending between both cores or each core may have its own set of fins 22 as desired. In this configuration, the inner manifold plate 38 has four of the nipples 44, two at each end. The two upper nipples 44 as seen in FIG. 2 are respectively disposed in an associated one of the headers 10 while the two lower nipples 44 are respectively disposed in an associated one of the two headers 12.

The spacer plate 42 includes a first internal cut-out 60 that aligns with the two upper nipples 44. As a consequence, fluid communication between the two upper headers 10 is established via the cut-out 60 but serves as a crossover passage from one module to the other.

The spacer plate 43 also includes an internal passage 62 having the configuration shown and still another internal passage 64 having the configuration shown. The internal passages are formed by cut-outs in the spacer plate 42. It will be seen that the passage 62 extends between the uppermost one of the nipples 50 and the left lower most one of the nipples 44. Thus, the upper fitting 48 is in fluid communication with the lower left header 12.

The cut-out 64 extends from the lower right header 12 to the lower fitting 48 and thus places the latter in fluid communication with the former.

Thus, it will be appreciated that one of the fittings 50 may be used as a fluid inlet to the heat exchanger while the other fitting 50 may be used as a fluid outlet. Fluid is passed into one of the modules, entering the header 12 thereof, to pass upwardly through the tubes 20 to the upper header 10 where it crosses over to the other header 10 via the passage 60. The fluid then descends through the tubes 20 of that module to the header 12 and ultimately exit the system through the other of the fittings 48.

As illustrated in FIGS. 1 and 2, the side piece 32 is a laminated construction that results in the passages being disposed at the interface between the inner and outer plates 38 and 40. In some instances, a two piece construction may be preferred. Such a two piece construction will be described with reference to FIGS. 3–5, inclusive.

Figure 3:
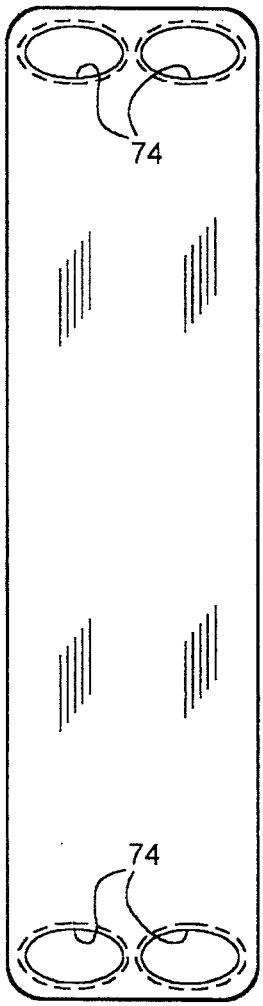
FIG. 3 is a view of part of a side piece made according to a modified embodiment of the invention.
Figure 4:
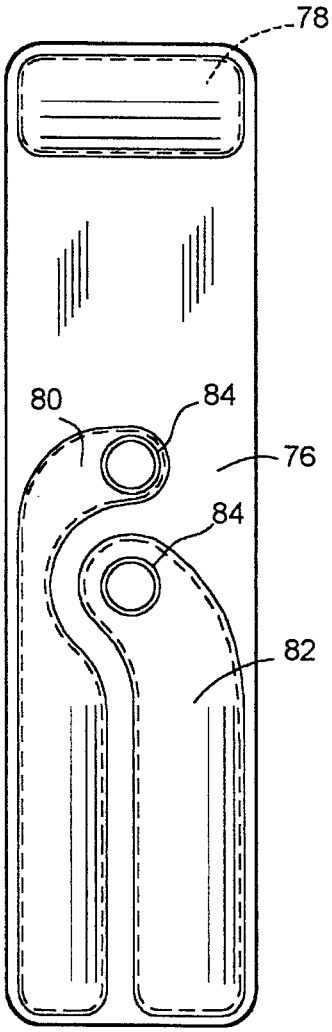
FIG. 4 is a view of another part of the side piece of the modified embodiment of the invention.
Figure 5:
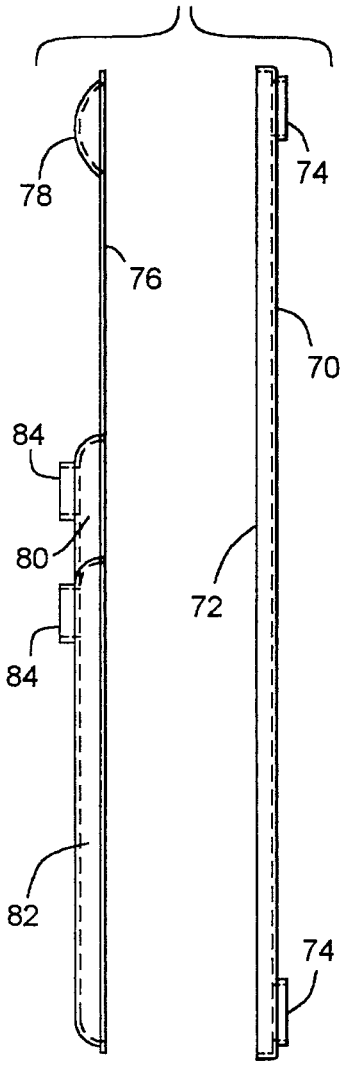
FIG. 5 is an exploded view illustrating the intended assembly of the parts of FIGS. 3 and 4 together.

Referring first to FIGS. 3 and 5, an inner plate 70 is basically planar but includes a peripheral flange 72 extending from one side thereof and integrally formed nipples 74 at the ends projecting from the opposite side thereof. The nipples 74 serve the same function as the nipples 44 and will not be further described.

Because the plate 70 is flat, it is ideally suited for bonding to the serpentine fins 22.

An outer plate 76 is also provided and is sized and shaped so as to nest within the peripheral flange 72 of the inner plate 70. Near its upper end, the plate 76 includes an elongated bubble 78 stamped in one side thereof so as to extend between and overlie the two upper nipples 74 to thereby establish a crossover passage corresponding to that shown at 60 in FIG. 2.

The outer plate 76 includes an additional bubble 80 that is configured as the cutout 62 as well as a further bubble 82 which is configured as the cutout 64. Both the bubbles 80 and 82 have, at their upper ends, integral stamped nipples 84 which extend away from the plate 70 and which are adapted to receive fixtures for connection to heat exchange fluid as is well known. The lower ends of the bubbles 80 and 82 extend downwardly to respectively overlie the left and right lower nipples 74 and thus provide for a passage of heat exchange fluid through the heat exchanger that is the same as that previously described in connection with the embodiment shown in FIGS. 1 and 2.

Between the bubbles, the plate 76 is flat so that it will abut the plate 70 and, when subjected to a typical bonding operation such as brazing, the flat areas on the plates 70 and 76 will braze to one another to seal the passages defined by the bubbles 78, 80 and 82 from one another and from the exterior of the heat exchanger.

As noted, brazing is a preferred method of assembly of the heat exchanger. Typically, its components will be formed of aluminum and where brazed joints are required, one or the other or both of the components will be provided with a braze clad at that location.

From the foregoing, it will be appreciated that the invention takes the usual function provided by a side piece and implements that as well as adding a new function whereby the same may serve to provide an inlet, an outlet and/or a crossover passage for the heat exchanger. As a consequence, the envelope between the headers 10 and 12 is not increased in that direction by the presence of fittings. Furthermore, the invention allows the fittings to be connected to the heat exchanger at some location other than the headers to provide an increase in design flexibility. And while the illustrated embodiment shows the fittings as being within the plane of the heat exchanger, those skilled in the art will readily appreciate that, if desired, plates such as the plates 70 and 76 could be extended to one side of the heat exchanger and provided with bubbles to extend to such locations so that the fittings could be located to the front or to the rear of the heat exchanger, rather than to the side thereof.

Similarly, the nipples 46 and/or 84 could be directed to the sides of the heat exchanger, 90° (or any other desired angle) from the position illustrated, if desired. Additionally, while the tubular headers 10, 12 are illustrated as being formed of a single piece of material, two or even more pieces of material may be used to form the tubular headers of the invention, so long as the interior passage is a passage such as illustrated.

In all events, many of the problems encountered with prior heat exchanger designs, and the use of inlets, outlets and cross over fittings therewith, are avoided through the use of the invention.

We claim:

1. A heat exchanger comprising:

first and second spaced, generally parallel, tubular headers having opposed ends;

a plurality of tubes in parallel and spaced from one another extending between and having their ends in fluid communication with the interiors of said headers;

a plurality of fins located between said headers and in heat exchange relation with said plurality and tubes; and side pieces flanking said plurality of tubes and plurality of fins and extending between and fastened to corresponding ones of said opposed ends of said headers, one of said side pieces including an internal passage terminating in a first port at and in fluid communication with one of said headers at one of said opposed ends and a second port at the other end of said passage.

2. The heat exchanger of claim 1 wherein said fins are serpentine fins and are bonded to said side pieces.

3. The heat exchanger of claim 1 wherein there are two said passages, two said first ports and two said second ports to provide first and second ports for each said passage; and said first ports are in fluid communication with different ones of said headers.

4. The heat exchanger of claim 1 wherein said second port is located in a side of said side piece remote from said plurality of tubes and said plurality of fins.

5. The heat exchanger of claim 1 further including an additional header closely adjacent said one of said headers; and wherein said second port is in fluid communication with said additional header.

6. The heat exchanger of claim 1 further including an additional set of said first and second headers and said plurality of tubes, and located in side by side relation to said first named first and second headers and plurality of tubes, with the first headers being in close adjacency to one another and the second headers being in close adjacency to one another; and there are three said passages, each having first and second ports, the first ports of said first and second passages being in fluid communication with respective ones of said first headers, and the second ports of said first and second passages being located oppositely of the respective said plurality of tubes; the ports of said third passage being in fluid communication with respective ones of said second headers.

7. The heat exchanger of claim 1 wherein said one side piece comprises a pair of plates with said passage being located at the interface of said plates.

8. The heat exchanger of claim 7 wherein one of said plates has a peripheral flange and the other of said plates is nested within said peripheral flange in substantial abutment with the other of said plates.

9. The heat exchanger of claim 7 further including a spacer between said pair of plates to define a laminated side piece.

10. A heat exchanger comprising:

a pair of side by side, heat exchange modules, each of said modules including first and second spaced, generally parallel, tubular headers having opposed ends and a plurality of spaced tubes extending in parallel with one another between the first and second headers, the ends of the tubes being in fluid communication with the interiors of the first and second headers;

a plurality of fins located between the headers and bonded to the plurality of tubes in heat exchange relation therewith; and side pieces flanking said plurality of tubes and said plurality of fins and extending between and fastened to corresponding ones of the opposed ends of the headers;

one of said side pieces including three internal passages, each terminating in spaced first and second ports;

the first ports of two of said passages being in fluid communication with the first headers of respective ones of said modules;

the second ports of said two passages being located on said side piece and remote from said tubes in said fins; and the first port of the third passage being in fluid communication with the second header of one of said modules and the second port of the third passage being in fluid communication with the second header of the other module to define a crossover passage.

11. The heat exchanger of claim 10 wherein said fin are serpentine fin and are bonded to said tubes and to said side pieces.

* * * * *